US005178076A

United States Patent [19]

Hand et al.

[11] Patent Number: 5,178,076

[45] Date of Patent: Jan. 12, 1993

[54] BIO-MASS BURNER CONSTRUCTION

[76] Inventors: David J. Hand, Rte. #1, Box 461, Warsaw, Va. 22572; Calvin H. Hand, Jr., 10150 E. Harvard, Apt. D 430, Denver, Colo. 80231; Stan E. Abrams, 4871 N. Mesa Dr., Castle Rock, Colo. 80104

[21] Appl. No.: 755,735

[22] Filed: Sep. 6, 1991

[51] Int. Cl.[5] ..... F23B 5/00

[52] U.S. Cl. ..... 110/210; 110/214; 110/235; 110/248; 110/328

[58] Field of Search ..... 110/328, 329, 345-347, 110/210, 212, 214, 248

[56] References Cited

U.S. PATENT DOCUMENTS

| | | | |
|---|---|---|---|
| 2,380,452 | 7/1945 | Kohout | 110/328 |
| 4,181,491 | 1/1980 | Hovis | 431/187 |
| 4,257,762 | 3/1981 | Zink et al. | 431/187 |
| 4,259,064 | 3/1981 | Laux et al. | 431/187 |
| 4,334,484 | 6/1982 | Payne et al. | 110/210 |
| 4,356,778 | 11/1982 | McRee, Jr. | 110/212 |
| 4,398,473 | 8/1983 | Loper | 110/329 |
| 4,487,138 | 12/1984 | Grebe | 110/329 |

*Primary Examiner*—Henry C. Yuen
*Attorney, Agent, or Firm*—Richard P. Matthews

[57] ABSTRACT

A bio-mass burner construction for alternate fuels at temperatures from about 1,800 degrees F. to about 2,800 degrees F. to replace oil and gas burners. The burner utilizes a first burning chamber having a falling fuel, entrained bed zone positioned above a traveling grate having a porous metallic woven belt. Primary air is directed through the porous belt to establish an oxygen-starved first burning chamber. A second burning chamber in fluid communication with the first burning chamber, but having a restricted diameter, effectively provides a hot air gas nozzle. The second burning chamber receives a superheated secondary air source from cored apertures in interfitting refractory block members which provide a refractory lining for a portion of the first burning chamber and receive heat from the first burning chamber to heat the secondary air. In larger sized units a plurality of conveyors constitute the traveling grate with the conveyors being arranged in head-to-head stepped relationship so that unburned fuel received by gravity from the entrained bed zone is agitated or jostled to enhance its burning. An automatic ash removal system receives ashes from the traveling grate in a U-shaped trough through which travels a heavy duty auger. A water misting bath is provided in the U-shaped trough to lower the ash temperature.

7 Claims, 7 Drawing Sheets

BIO-MASS BURNER CONSTRUCTION

This invention relates to a bio-mass burner construction and, more particularly, to such a burner which utilizes a falling fuel, entrained-bed zone above a moving grate.

BACKGROUND OF THE INVENTION

Heretofore, bio-mass burners have been used to burn a variety of fuels. Typical examples of these are found in U.S. Pat. Nos. 4,295,956; 4,341,199 and 4,475,471 to Hand et al. The grate structure used in these patents has been especially troublesome because of the stresses and strains encountered when the temperature varies from room temperature to approximately 1800 degrees F. to 2800 degrees F. While it has been known to use low ash content fuels, a problem exists, nevertheless, with respect to ash removal from the burning chamber.

SUMMARY OF THE INVENTION

In accordance with the present invention, a falling fuel, entrained-bed zone is positioned above a traveling grate which is comprised of porous metallic belts through which a primary source of air is delivered. Interfitting cored-aperture refractory block members which provide insulation for a portion of a first burning chamber are positioned to deliver a preheated secondary air source to the second combustion chamber while avoiding the stresses and strains encountered previously in tortuous path grate members.

The problem of ash removal is solved by providing a water-cooled automatic ash removal system which receives ash materials directly from the traveling grate.

The bio-mass fuels which are burned in the burner construction of this invention include wood chips and sawdust, paper and cardboard, refuse derived fuel (RDF), peanut shells, rice hulls, rubber tires, carpet remnants and the like and are referred to herein as alternate fuels, that is, other than oil and gas. The ability to burn inexpensive alternate fuels efficiently and cleanly reduces cost and pollutants. The burner construction of this invention is designed to be retrofitted to most boilers now burning gas or oil.

The inherent advantages and improvements of the present invention will become more readily apparent by reference to the following detailed description of the invention and by reference to the drawings wherein.

DETAILED DESCRIPTION OF THE PREFERRED EMBODIMENT

Figure 1:
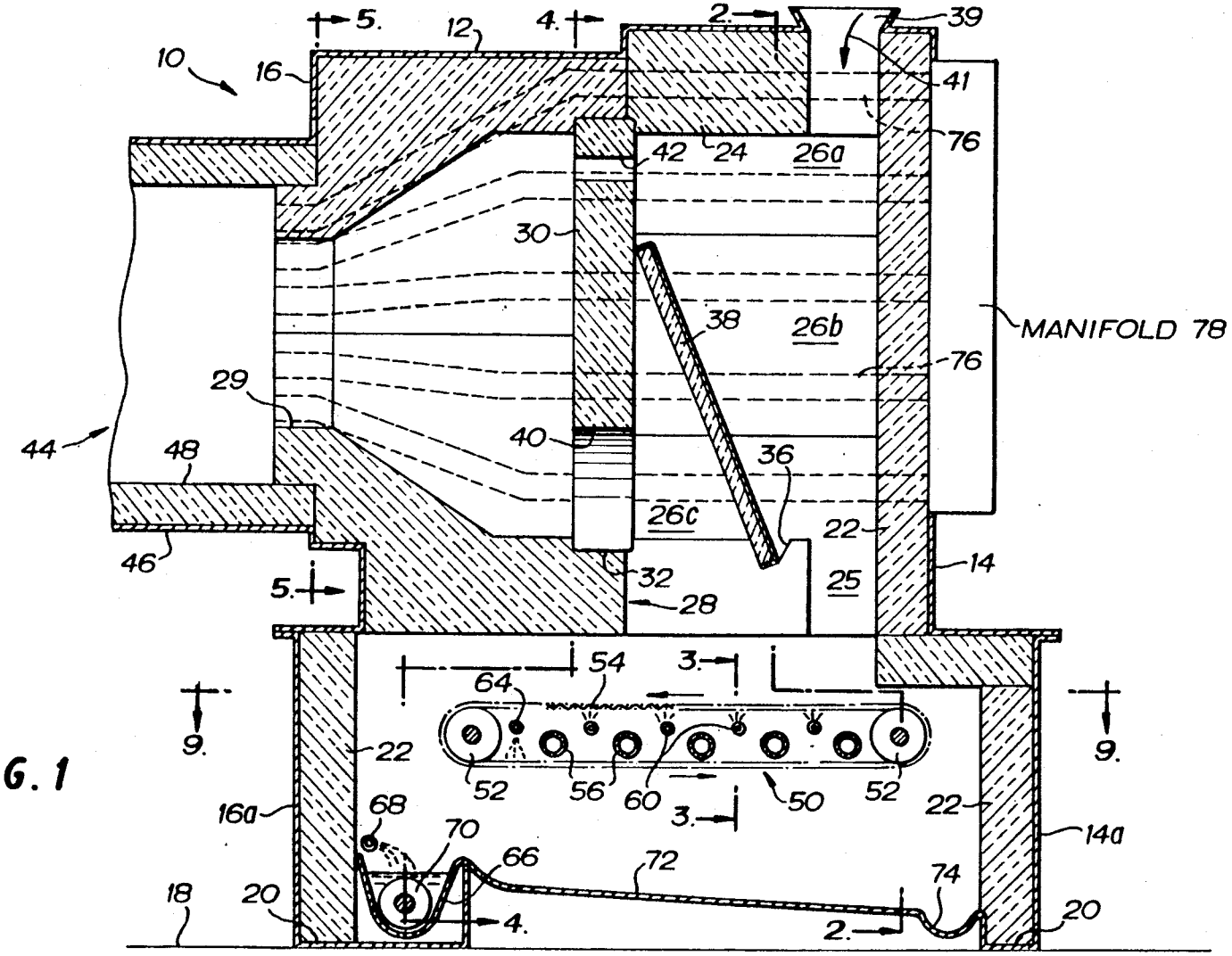
FIG. 1 is a fragmentary front elevational view of the burner construction of the present invention taken in vertical cross section.

Referring now to FIG. 1 of the drawings, there is shown a burner, indicated generally at 10. The burner is enclosed within top wall 12, back wall 14, 14*a*, front wall 16, 16*a*, and bottom wall 20 which rests on foundation 18. Sidewalls 15 and 17 are shown in FIGS. 2–5, 7 and 9. The walls and top are lined with two inch hard board insulation capable of withstanding 2,000 degrees F. and with two to four inch monolithic refractory material 22 capable of withstanding temperatures of 3,200 degrees F. to provide a pyrolytic burning chamber 25.

Figure 2:
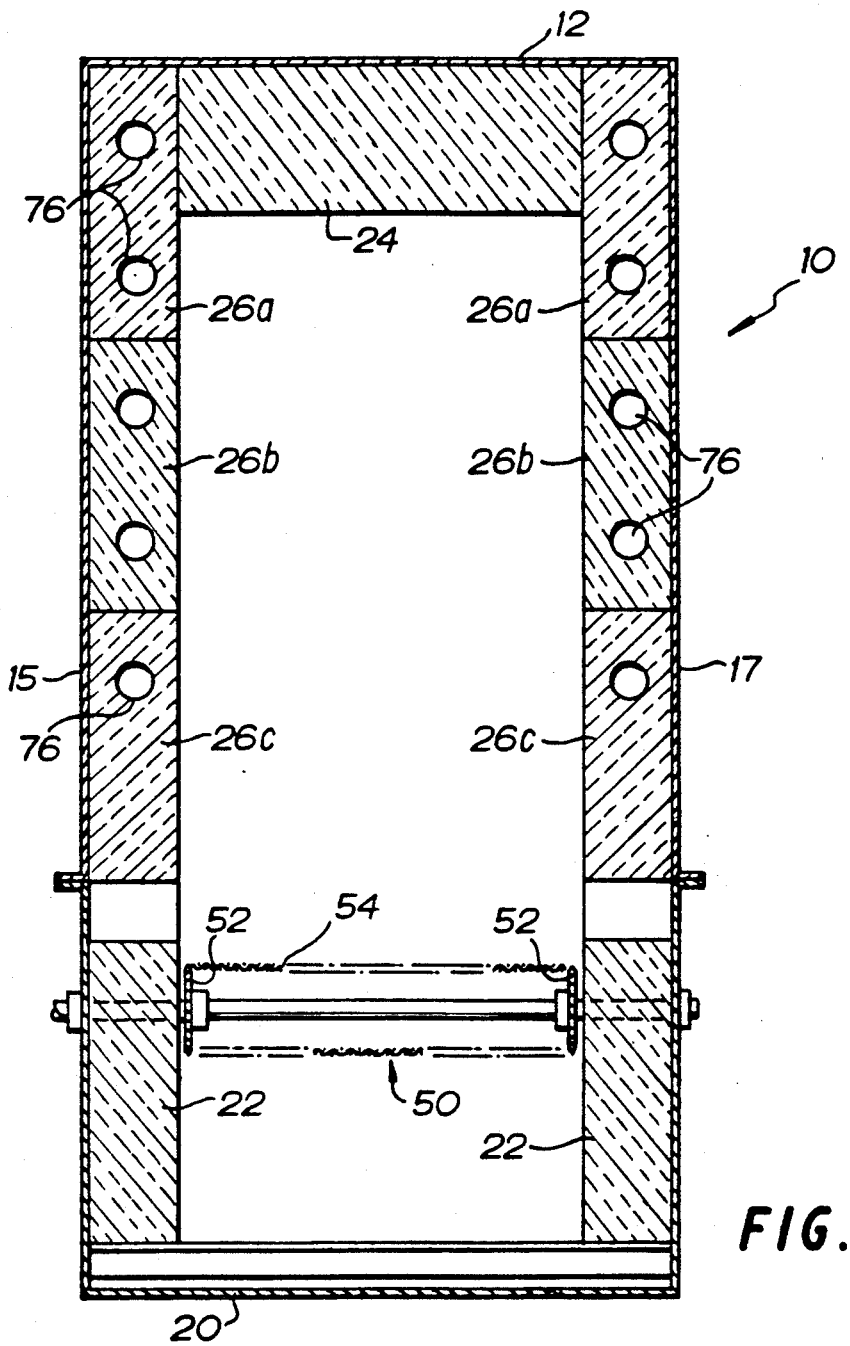
FIG. 2 is an end elevational view taken in vertical cross section along line 2—2 of FIG. 1.
Figure 3:
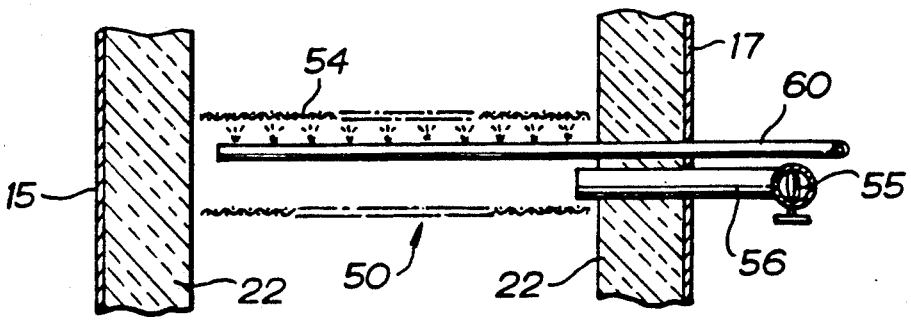
FIG. 3 is a fragmentary end elevational view taken in vertical cross section along line 303 of FIG. 1.
Figure 4:
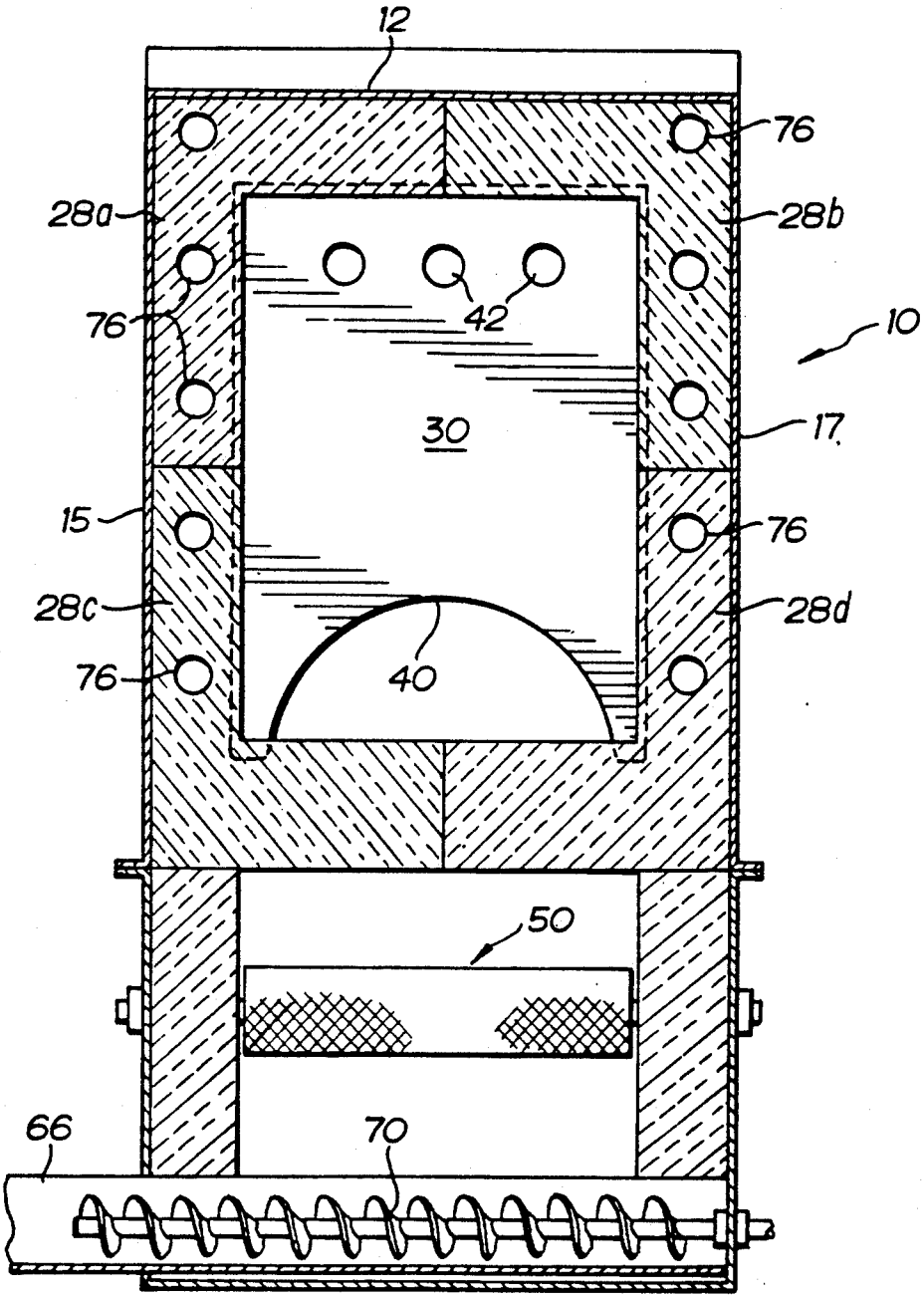
FIG. 4 is a fragmentary end elevational view taken in vertical cross section along line 4—4 of FIG. 1.
Figure 5:
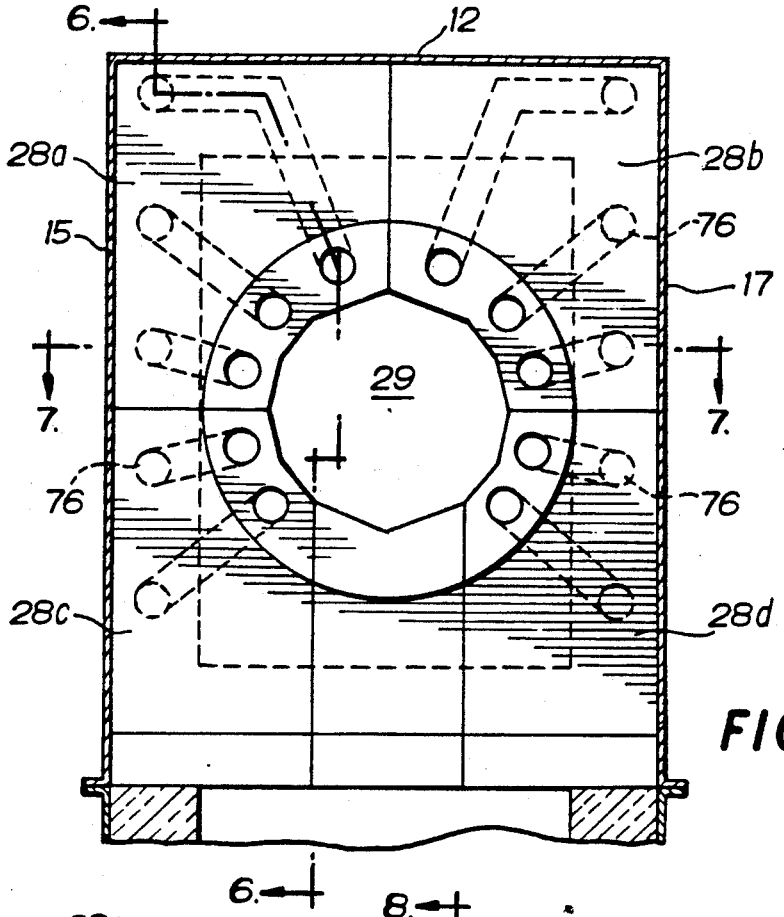
FIG. 5 is a fragmentary end elevational view taken in vertical cross section along line 5—5 of FIG. 1.
Figure 6:
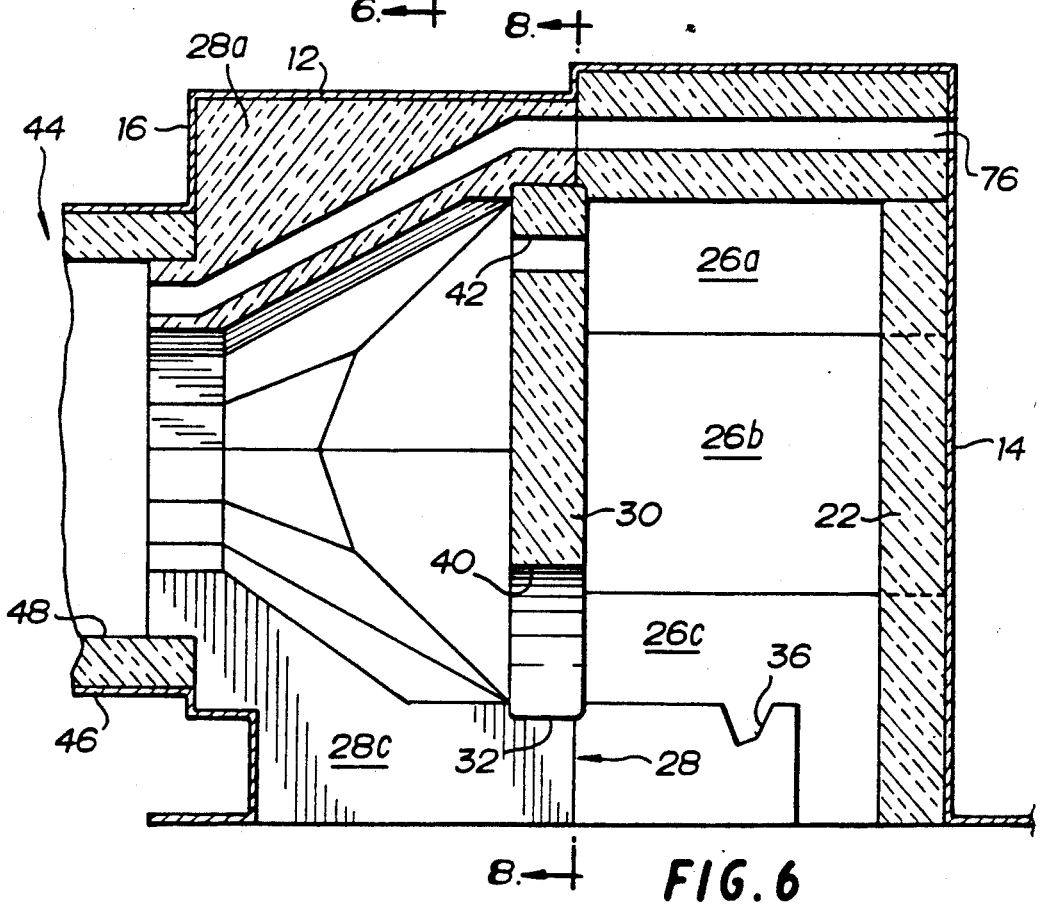
FIG. 6 is a fragmentary front elevational view taken in vertical cross section along line 6—6 of FIG. 5.
Figure 7:
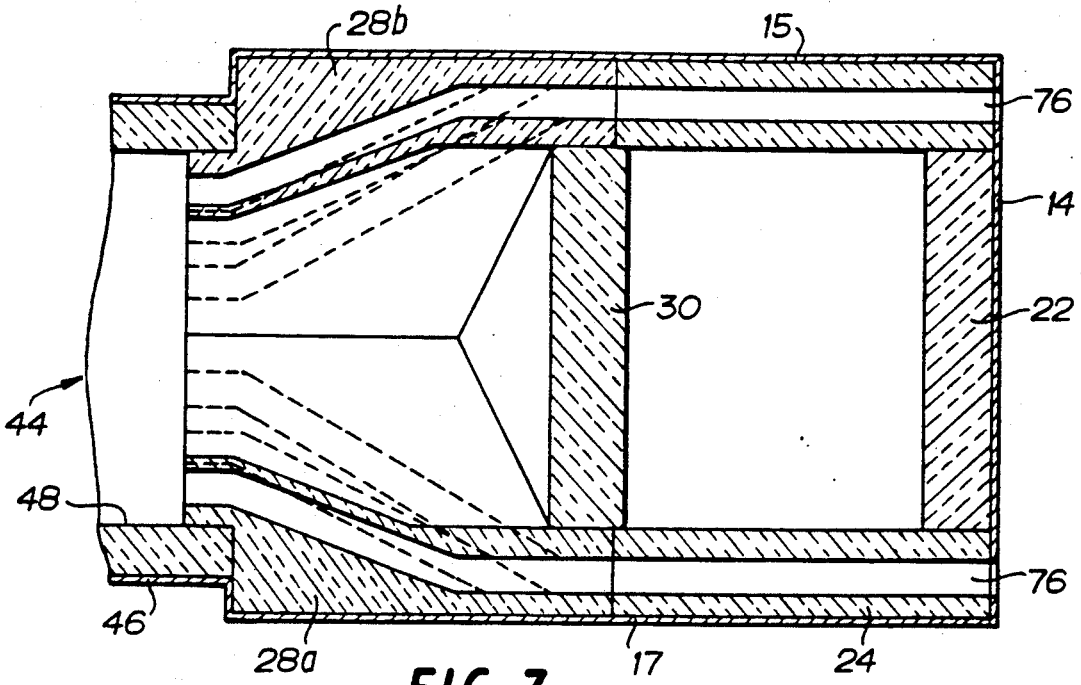
FIG. 7 is a fragmentary top elevational view taken in horizontal cross section along line 7—7 of FIG. 5.
Figure 8:
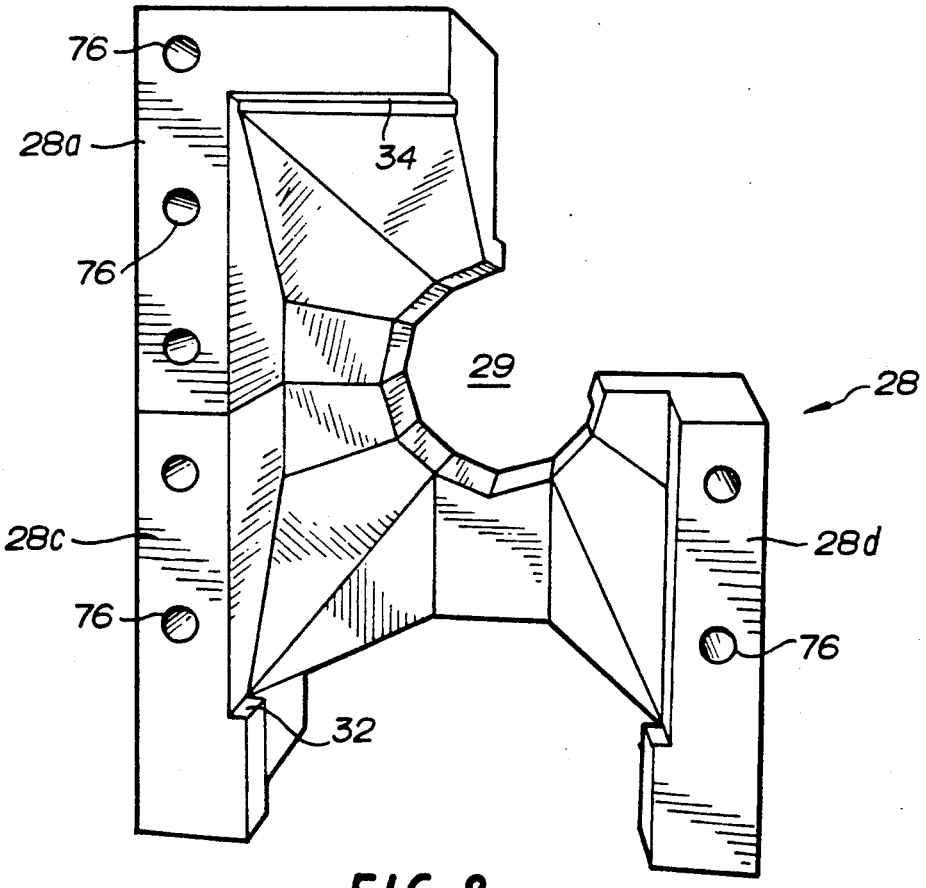
FIG. 8 is a perspective view of the refractory blocks of FIG. 1 taken in the direction of line 8—8 in FIG. 6 with one block removed.

Burner 10 is provided with a horizontal extending insulation 24 provided with an aperture in communication with an opening for the input of fuel at 39 with the fuel being maintained in a holding or storage bin, not shown, and which is automatically conveyed into a metering bin and automatically fed by conveyor means such as is shown in U.S. Pat. No. 4,475,471 into opening 39 in a downwardly, free falling direction as is indicated by arrow 41. The sidewalls of the burning chamber 25 are lined with vertically stacked blocks such as are shown in FIG. 2 at 26*a*, 26*b*, and 26*c*. These blocks are refractory blocks capable of withstanding 3,200 degrees F. and provided with apertures 76 for a purpose to be described hereinafter in the conveyance of secondary air. A refractory block member is indicated generally at 28. Reference is made to FIG. 8 to illustrate the configuration of refractory block member 28 which is assembled from four quadrant blocks 28*a*, 28*b*, 28*c* and 28*d*. 28*b* is removed from FIG. 8 for purposes of illustration. At the forward face of refractory block 28 each individual quadrant block is provided with shoulder means 32, 34 for purposes of supporting a thermal shield member 30 which is also supported by notched supports in the corners of side insulation blocks 26*a* and 26*c*. As shown in FIG. 4, thermal shield 30 is provided with apertures 42 and a semicircular opening 40 in order to permit passage of heated fuel and gasses through the first burning chamber 25 toward the exit 29 of the four quadrant refractory members 28*a*, 28*b*, 28*c* and 28*d* and directed into a second combustion chamber indicated generally at 44. The secondary air is forced through apertures 76 in the four quadrant components of refractory block member 28. The refractory block member 28 derives its air from a suitable pump member, not shown, connected to manifold 78 and establishes a turbulent, venturi-like air flow into the second combustion chamber 44.

In the lower portion of FIG. 1 of the combustion chamber 25, there is illustrated a traveling grate 50 onto which any fuel which has passed through the entrained bed free falling zone in chamber 25 is deposited and moved toward the left end of FIG. 1. Most of the fuel is gasified before it reaches the traveling grate 50. Only one traveling grate is illustrated in FIG. 1, but more than one traveling or moving grate members may be used depending upon the horsepower required from the burner. Horsepower outputs which vary from 100 to 1000 are available from this invention. The traveling grate 50 constitutes a shallow bed moving grate zone and combined with the falling fuel, entrained-bed zone result in a relatively small fuel inventory being in the burner at any given time.

Figure 9:
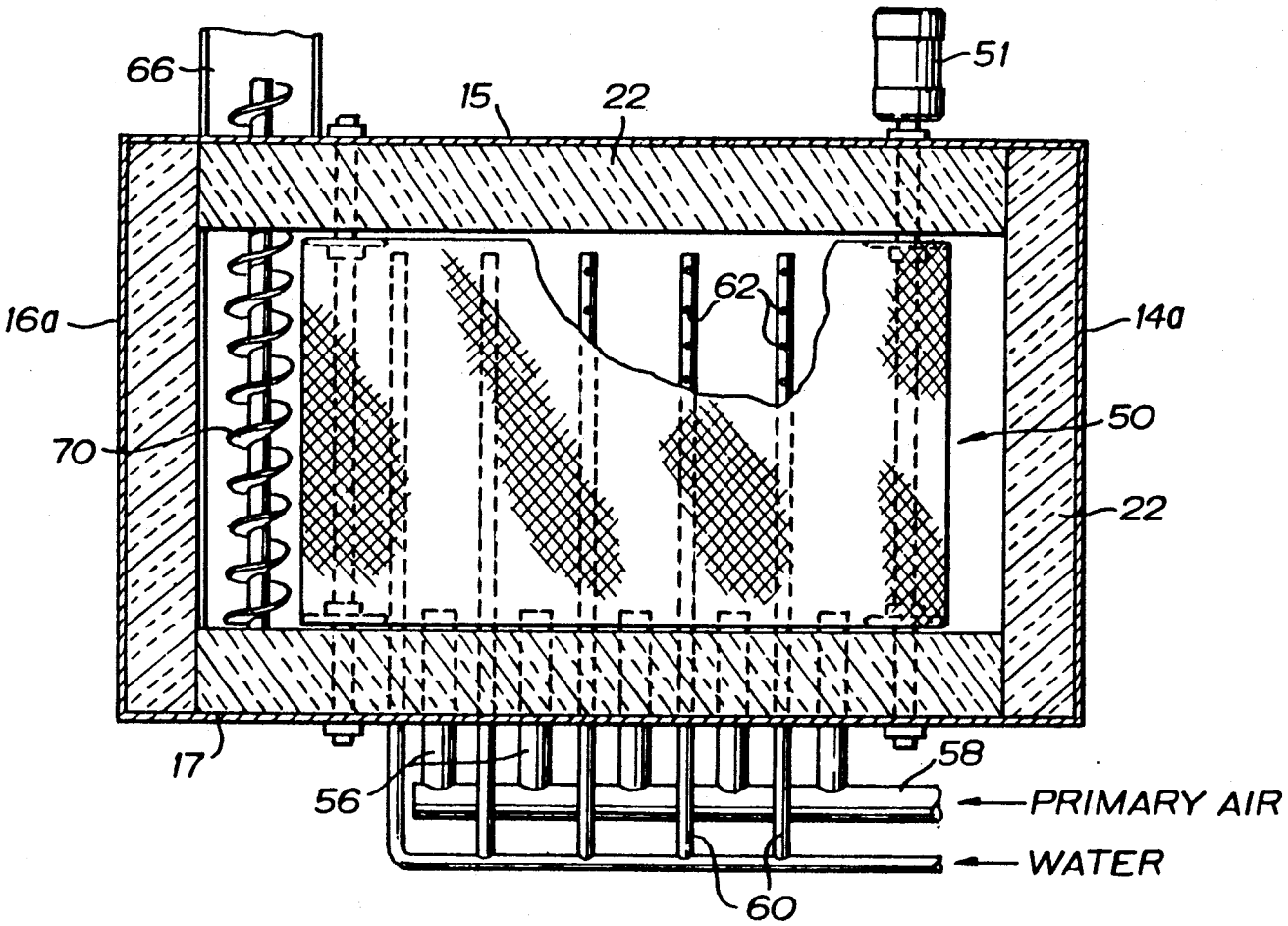
FIG. 9 is a fragmentary plan view taken in horizontal cross section along line 9—9 of FIG. 1.

It will be observed that the traveling grate 50 is provided with suitable end sprockets 52 about which is entrained a continuous belt 54. The surface of belt 54 is porous, made from stainless steel, and possesses a porosity of at least 20%. Primary air from a suitable pump means, not shown, is passed into a manifold 58, as shown in FIG. 9, and inserted between the upper and lower flights of support belt 54. The sides of the traveling grate 50 between the upper and lower flights of belt 54 are closed substantially either by the position of the insulation wall 22 or by other suitable means. Therefore, the only escape for the primary air that is introduced between the flights of the belt is through the porous surface of the belt itself. This results in oxidation and burning of the fuel. The quantity of primary air is regulated such as a damper or valve control 55 shown in FIG. 3, to provide an oxygen-starved combustion in the primary burning chamber 25. Another means for controlling and establishing the oxygen supply of combustion is by regulation of the speed of the fan supplying air to manifold 58. This feature is also used to control the temperature of combustion. FIG. 9 also shows that water in misting form is introduced between the flights of the traveling belt by means of tubular members 60 which are provided with apertures 62 as shown in FIG. 9. The leftmost water tube 64, illustrated in FIG. 9, discharges water downwardly rather than upwardly so as to clean the porous belt 64 as it passes over the leftmost sprocket 52 in FIG. 1. The misting bath introduced between the upper and lower flights of belt 54 prevents clinkers from forming in the ash and also provides control of the primary air temperature.

The burner construction of this invention is also provided with an automatic ash removal system. The belt of traveling grate 54 travels at a low speed and carries the burning waste from the back to the front in primary burning chamber 25. The rate of travel of the belt depends upon the type of fuel being burned and the residence time required to complete the burning. As the burned material moves to the end of belt 54, it drops off onto a thick, refractory-lined, U-shaped trough 66, through which travels a heavy duty auger 44. This auger is constructed with one -quarter inch flighting on a two inch shaft designed to withstand high temperatures. The ash material is carried out of the primary chamber 25 through a water misting bath provided by spray nozzle 68 shown in FIG. 1. The hot ash is thus cooled before being delivered and emptied into a container, not shown, outside the primary burning chamber 25. The ash auger 70 has an auto-reverse feature which will clear most obstructions without any action by an operator. Should a jam occur, the entire system will shut down. Access doors, not shown, in the front and rear walls 16, 14 permit easy entry to the burning chamber 24 to the ash auger 44. A downwardly sloping stainless steel wall 72 carries debris and residue provided by the spray nozzle 64 in cleaning belt 54 and this is delivered into a catch basin 74.

A second burning chamber is provided by tubular section 44 which is provided with insulation 48 and a metallic steel exterior 46. The second burning chamber 44 is approximately four feet in length and is flanged to a boiler or the like as is shown in U.S. Pat. No. 4,475,471. The secondary burning chamber 44 is positioned in fluid communication with the first burning chamber 25 by virtue of opening 29 in the refractory block member 28 as shown best in FIGS. 5 and 8 and by the plurality of cored apertures 76 which pass through the four quadrant blocks 28*a*, 28*b*, 28*c* and 28*d* which comprise the refractory block member 28. The end of the apertures 76 establish a series or set of Venturi-like flows at the exit of the refractory block member 28 into the second burning chamber 44. The flame is projected from the second burning chamber horizontally in the air that can easily fill the tubes of a Morrison tube boiler or the like to which the second burning chamber is attached. The burner of the present invention is compatible with a wide variety of boilers, kilns and heat exchangers. Because the burner is an extremely efficient power source, it can be used for the generation of steam or hot water, for absorption chillers in air conditioning and refrigerators, and for the cogeneration of electricity.

Figure 10:
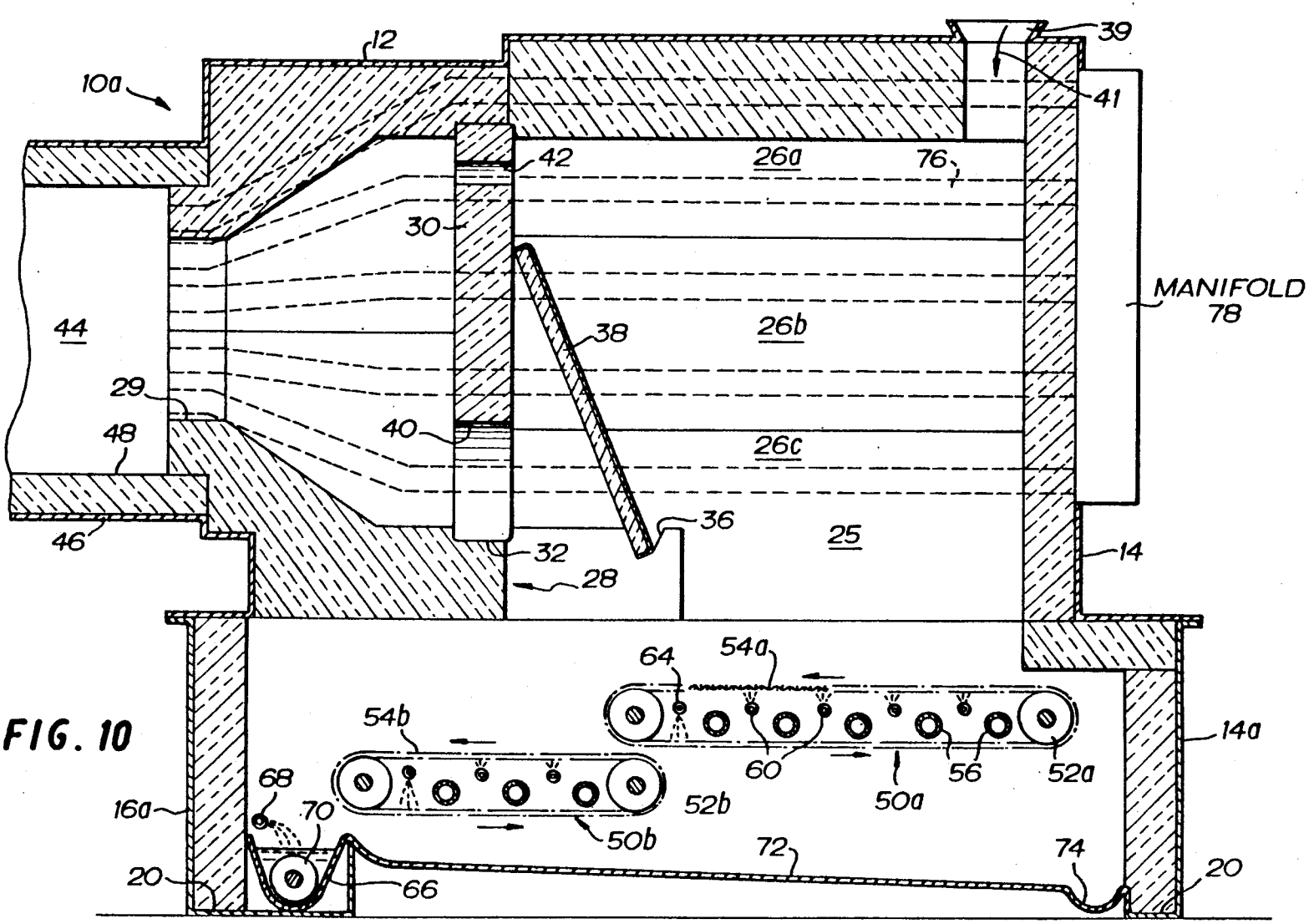
FIG. 10 is a fragmentary front elevational view of a modified burner construction taken in vertical cross section.

A modified form of the invention is illustrated in FIG. 10. In this embodiment, two travelling grates 50*a*, 50*b* are positioned in head-to-head relationship, and disposed at different elevations whereby fuels drop progressively from a higher belt 54*a* to a lower belt 54*b*, thereby agitating and jostling the fuel to enhance the burning thereof. The use of a plurality of traveling grates such as 50*a* and 50*b* is used in burners which produce higher horsepower.

In operation, an induced draft fan or stack fan, not shown, is for a predetermined length of time to purge the system and evacuate any ash that may have accumulated in the burner during non-operating periods. The system has so few moving parts that an automatic start-up and run control may be employed. After purging, it is customary to use ignition burners, not shown, but illustrated and described in U.S. Pat. No. 4,475,471 to start combustion. These ignition burners are used in the start sequence and partially in any re-starts, and can be operated with #2 fuel oil, kerosene, natural gas or propane. Fuel is supplied automatically on demand through opening 39. The fuel falls by gravity through the entrained bed zone above traveling grate 50 or 50*a*. Primary air is supplied through tubes 60 and is directed through the porous surface of belt 54 of each of the traveling grates to establish an oxygen-starved combustion zone in the primary burning chamber. After the proper temperature is achieved, air is supplied through tubular members 76 to cause a secondary burning which creates a blow torch effect and projects a flame into a Morrison tube or boiler to heat the water therein.

The second burning chamber 44 is positioned in fluid communication with the primary burning chamber and at the proper time, receives superheated secondary air from tubular members 76 which are disposed in refractory block member 28 and are heated by the gasification and combustion occurring the primary burning chamber 25. The end of apertures 76 passing through refractory block member 28 establishes a Venturi-like turbulent flow in the second burning chamber which draws unburned fuel from the first burning chamber to complete the combustion.

A preferred refractory material use to make refractory block members and other insulating members of the present invention is supplied as product 57A by A. P. Green Industries, Inc of Mexico, Mo. 65265. This product will withstand temperatures of up to 3200 degrees F.

The use of stainless steel tubes to convey the secondary air through the first combustion chamber 25 was tried initially. These stainless steel tubes would not withstand the temperatures encountered in the practice of this invention. The stainless steel tubes began to sag and melt.

The cored apertures 76 produced in the refractory members of this invention are produced by a process similar to the well known "lost wax" process.

The burner of the present invention is a close-coupled system which gives the burner a distinct advantage over other systems. The temperature is controlled by use of initial start-up oil burners and by variation of grate speed and primary air damper position as well as by the use of misting water zones in between the belt of the traveling grate members.

The burner construction of the present invention represents a major breakthrough in the alternate fuel industry because it reduces dependency on fossil fuels and decreases the volume of waste that are rapidly filling up our unpopular and fast disappearing land fills.

While presently preferred embodiments of the invention have been illustrated and described, it will be recognized that the invention may be otherwise variously embodied and practiced within the scope of the claims which follows:

We claim:

1. A burner construction for burning alternate fuels at temperatures from about 1800 degrees F. to about 2800 degrees F. to replace oil and gas burners which comprises:

(a) a first burning chamber having a falling fuel entrained bed zone positioned above a traveling grate which is provided with a continuous belt having a porous surface throughout upper and lower flights, (b) a primary air source admitted into said first burning chamber and passing through the porous surface of said continuous belt with air from said primary air source establishing an oxygen-starved combustion zone in said first burning chamber, (c) a second burning chamber positioned in fluid communication with said first burning chamber, (i) said second burning chamber receiving a superheated secondary air source from cored apertures in refractory block members which provide a refractory lining for a portion of said first burning chamber, (ii) said cored apertures in said refractory block members being positioned at the entrance of said second burning chamber to establish a venturi-like turbulent flow in said second burning chamber which draws unburned fuel from said first burning chamber to complete the combustion thereof in said second burning chamber.

2. A burner construction as defined in claim 1 wherein said moving grate has at least one change of level position where unburned fuel drops by gravity from an upper level to a lower level to increase tho combustion of said unburned fuel.

3. A burner construction as defined in claim 2 including an ash removal trough provided with feed means to dispose of ash material received in said ash removal trough from said moving grate, said ash removal trough being partially filled with water.

4. A burner construction as defined in claim 1 wherein said moving grate has stainless steel woven belts having a porosity of at least 20 percent.

5. A burner construction as defined in claim 1 wherein said refractory block members interfit with one another and said refractory block members support a refractory thermal shield member in said first burning chamber to restrict the flow path of fuel toward said second burning chamber.

6. A burner construction as defined in claim 1 wherein said moving grate is substantially sealed along the peripheral edges of said continuous belt and means for inserting a misting water cooling means between the upper and lower flights of said belt to regulate the temperature in said first burning chamber.

7. A burner construction as defined in claim 6 wherein said means for inserting a misting water cooling means includes at least one downwardly directed spray to clean said porous belt as it passes by a downstream positioned sprocket member for said moving grate.

* * * * *